US005309168A

United States Patent [19]

Itoh et al.

[11] Patent Number: 5,309,168

[45] Date of Patent: May 3, 1994

[54] PANEL DISPLAY CONTROL DEVICE

[75] Inventors: Shuhei Itoh; Mitsuhiro Kurata, both of Hamamatsu, Japan

[73] Assignee: Yamaha Corporation, Hamamatsu, Japan

[21] Appl. No.: 784,776

[22] Filed: Oct. 30, 1991

[30] Foreign Application Priority Data

Oct. 31, 1990 [JP] Japan ..... 2-295610
Mar. 28, 1991 [JP] Japan ..... 3-89845

[51] Int. Cl.[5] ..... G09G 3/00

[52] U.S. Cl. ..... 345/3; 345/98; 345/185

[58] Field of Search ..... 340/717, 739, 798, 799, 340/784, 793, 805; 364/900; 345/1, 3, 89, 98

[56] References Cited

U.S. PATENT DOCUMENTS

| | | | |
|---|---|---|---|
| 4,716,460 | 12/1987 | Benson et al. | 340/739 |
| 4,727,363 | 2/1988 | Ishii | 340/798 |
| 4,742,347 | 5/1988 | Arismendi | 340/717 |
| 4,760,387 | 7/1988 | Ishii et al. | 340/717 |
| 4,779,083 | 10/1988 | Ishii et al. | 340/793 |
| 4,816,816 | 3/1989 | Usui | 340/784 |
| 4,845,473 | 7/1989 | Matsuhashi et al. | 340/784 |
| 4,855,728 | 8/1989 | Mano et al. | 340/717 |
| 4,860,246 | 8/1989 | Inoue | 364/900 |
| 4,998,100 | 3/1991 | Ishii | 340/805 |

*Primary Examiner*—Alvin E. Oberley
*Assistant Examiner*—Steven J. Saras
*Attorney, Agent, or Firm*—Spensley Horn Jubas & Lubitz

[57] ABSTRACT

A CRT controller is operated in accordance with a basic clock for a panel display and repeats a wait operation in response to a wait signal produced by a panel timing controller, which causes a compulsory synchronization with the panel timing. A ½ frame buffer is also provided. Display data supplied by the CRT controller and display data read from the ½ frame buffer are alternately selected such that data is supplied in an order conforming to the panel display of a double screen type panel display. A display of the double screen type panel display is controlled in accordance with an application program directed to a CRT display without modifying the order of the display data produced by the CRT controller and without changing the timing data which has been set in the CRT controller. The ½ frame buffer may be a general-purpose memory which stores ½ frame and one line of the panel display data. A ½ frame buffer control circuit shifts a writing address of the ½ frame buffer by one line in a reverse direction to a direction of scanning for writing at the beginning of each new frame.

2 Claims, 8 Drawing Sheets

PANEL DISPLAY CONTROL DEVICE

BACKGROUND OF THE INVENTION

This invention relates to a panel display control device performing display control of a panel display having display timing which is different from a CRT display. The panel display control device uses an application program produced for the CRT display and, more particularly, the panel display control device performs display control of a single drive type panel display having a screen which is divided into two sections.

In conformity with the recent tendency to reduce the size of office automation equipment, including personal computers and word processors, panel type displays such as liquid crystal and plasma displays are used more often as displays for these types of office automation equipment than CRT displays which have been predominantly used in the past.

As the panel type displays have become larger, to conform to the size of office automation equipment, there has been developed for the purpose of reducing the electrode capacity a double screen single drive type LCD panel display. As shown in FIG. 5, an LCD panel 21 is divided into two screens, for example an upper and a lower screen, which is driven by shift registers 22 and 23. In this type of display, as shown in FIG. 6, panel display data PDA of lines 1–240 constitute the upper screen and panel display data PDA of lines 241–480 constitute the lower screen. The data for the upper and lower screens is supplied alternately line by line.

The display timing of the panel type display is generally different from that of the CRT display. For this reason, when the prior art double screen single drive type panel display is to be driven [by] using an application program produced for the CRT display, the following method is generally adopted.

First, contents of a timing control register of an existing CRT controller are set at a timing which is equivalent to the timing of the panel display.

Then, a memory (VRAM) provided for display purposes and controlled by the CRT controller is accessed alternately for the upper and lower screens. To accomplish this, there are provided two memory address generation circuits for the upper and lower screens.

However, in a case where the contents of the controlling register are set to meet the timing of the panel display as described above, contents of the timing controlling register in the CRT controller are rewritten when the display mode is to be changed. The application program and the resulting contents of the register will not meet the set timing requirements for the panel display causing a failure in the display operation. Therefore, operation means such as a local CPU for converting the contents of the register set for the CRT display to the timing data for the panel display is required. This results in an increase in the cost of the components for the device.

Moreover, according to the above-described method in which the memory addresses are alternately produced for the upper and lower screens, special address generation circuits including two counters of different preset values are required.

Therefore, it is an object of the invention to provide a panel display control device capable of smoothly controlling the display of the double screen type panel display by using timing data set for the CRT display without substantially increasing the cost of the components for the device.

It is another object of the invention to provide a panel display control device which is capable of smoothly controlling the display of the double screen type panel display by using timing data for the CRT display. The display control device may also employ a general-purpose memory as a frame buffer.

SUMMARY OF THE INVENTION

The panel display control device according to the embodiment of the present invention, which achieves the first object of the invention comprises clock generation means for generating a basic clock on the basis of which display timing of a panel having a first and a second screen display is determined. The device includes a CRT controller operated in response to the basic clock and which provides a display timing signal for the panel display and display data in accordance with a set timing value stored inside from an externally supplied wait signal. There is also a panel data conversion circuit for converting the display data provided by the CRT controller to display data for the panel display, and a buffer storing at least ½ frame of the panel display data provided by the panel data conversion circuit. The device further includes a panel timing controller operated in response to the basic clock and which provides the wait signal for synchronizing the CRT controller with [a] the panel display timing. The panel timing controller also provides a screen switching signal for switching the first and second screen synchronized with the wait signal, and a display control signal for the panel display. The panel display control device has buffer control means for controlling read timing and write timing of the buffer in response to the screen switching signal, such that the buffer control means writes the panel display data provided by the panel data conversion circuit line by line into the ½ frame buffer and reads out data of the ½ frame stored in the ½ frame buffer line by line. The device further includes a data control circuit for [selecting] alternately selecting the display data provided by the panel data conversion circuit and the display data provided by the ½ frame buffer, and then supplying the selected display data to the panel display.

According to the present invention, the CRT controller is operated in accordance with the basic clock for the panel display and repeats the wait operation in response to the wait signal produced by the panel timing controller such that a compulsory synchronization with the panel timing can be achieved. Further, the device according to the present invention includes the ½ frame buffer, such that the display data supplied by the CRT controller and the display data which is read out from the ½ frame buffer are alternately selected. This allows the data to be supplied in an order conforming to the panel display of a double screen type panel display.

According to the present invention, a display on the double screen type panel display can be controlled in accordance with an application program directed for use with a CRT display without modifying the order of the display data produced by the CRT controller and without changing the timing data which has been set in the CRT controller. This provides a panel display control device having excellent interchangeability.

Further, according to the present invention, the capacity of the required buffer is only for ½ frame and, accordingly, there is no substantial increase in the amount of hardware.

A panel control device according to an embodiment of the present invention, which achieves the second object of the invention includes the above-described structure of the panel display control device which achieves the first object of the invention, but is further characterized in that the ½ frame buffer is a general-purpose memory. The frame buffer stores ½ of a frame and one line of the panel display data. The ½ frame buffer control means shifts a writing address of the ½ frame buffer by one line in a reverse direction to a scanning direction for writing at the beginning of each new frame.

According to this aspect of the present invention, the device includes a general-purpose memory used as the buffer storing 178 frame of data and one line. A special addressing arrangement is provided for reading from and writing to this general-purpose memory buffer, such that data can be supplied in an order conforming to the panel display of the double screen type panel display by alternately selecting the display data which is supplied by the CRT controller and the display data which is read from the buffer.

BRIEF DESCRIPTION OF THE DRAWINGS

Preferred embodiments of the present invention will be described below with reference to the accompanying drawings.

DESCRIPTION OF PREFERRED EMBODIMENTS

An embodiment of the present invention will be described with reference to FIGS. 1 to 4A and 4B.

Figure 1:
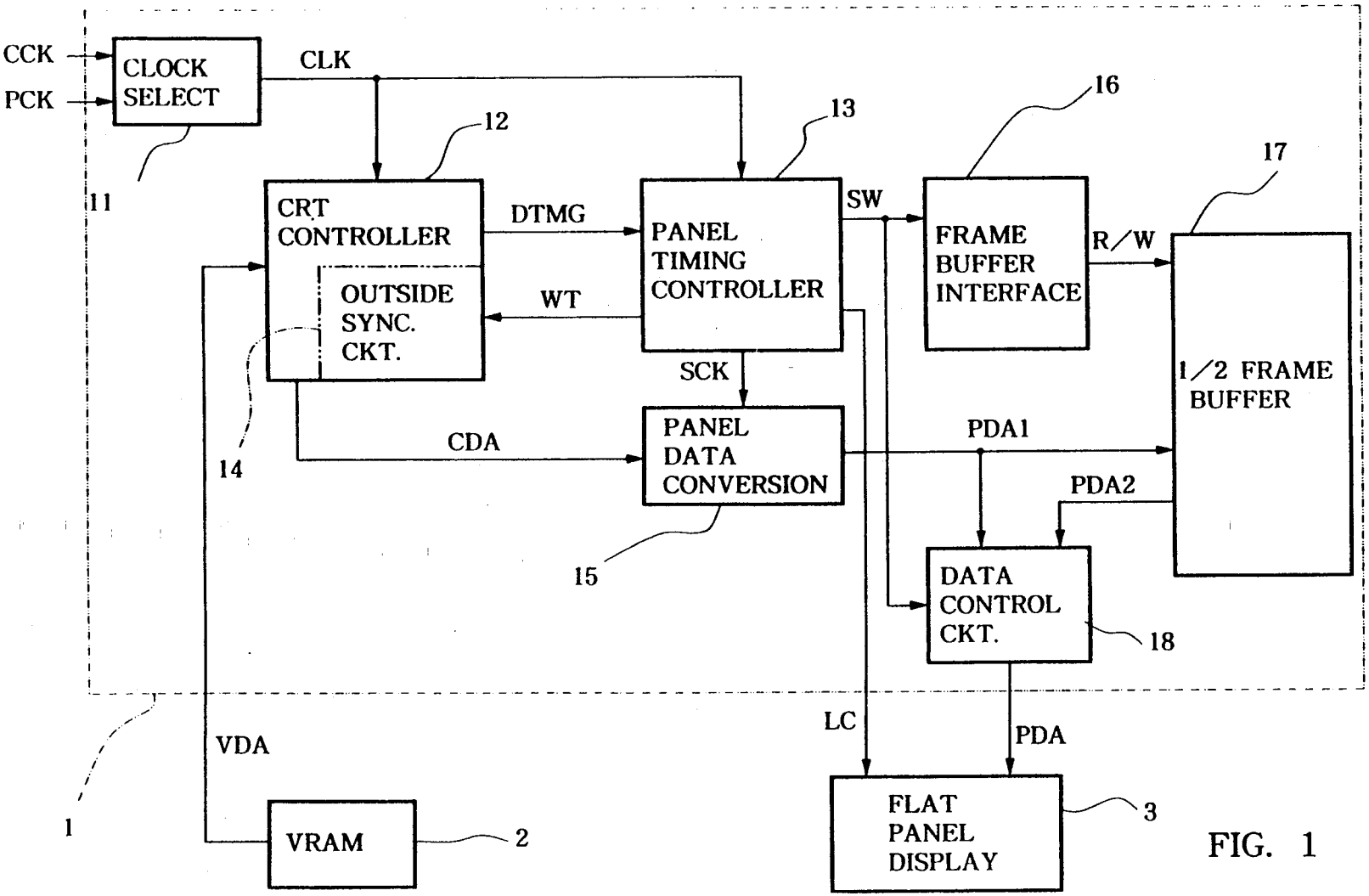
FIG. 1 is a block diagram showing an embodiment of the present invention.

FIG. 1 is a block diagram showing a display controller 1, a display memory (hereinafter referred to as "VRAM") 2 and a flat panel display 3 of an embodiment of the present invention.

In the display controller 1, a CRT clock signal CCK determining the display timing of a CRT display and a panel clock signal PCK determining the display timing of a panel display are selected by a clock selection circuit 11. The selected signal is supplied as a clock signal CLK to a CRT controller 12 and a panel timing controller 13. These controllers 12 and 13 are operated in response to the clock signal CCK for the CRT display when a display control for the CRT display (not shown) is performed and to the clock signal PCK for the panel display when a display control for the flat panel display 3 is performed.

The CRT controller 12 includes register (not shown) for timing control and an outside synchronizing circuit 14. The CRT controller 12 supplies to a CRT controller (not shown) timing signals including a horizontal synchronizing signal responsive to a timing data set in the timing controlling register. The CRT controller 12 also supplies a display timing signal DTMG to the panel timing controller 13. The CRT controller 12 causes the display timing signal DTMG to synchronize with the panel display timing by applying a delay to the display timing signal DTMG in response to a wait signal WT provided by the panel timing controller 13. The CRT controller 12 successively accesses the VRAM 2 to read display data VDA which is supplied to a panel data conversion circuit 15 as CRT display data CDA.

The panel timing controller 13 generates the wait signal WT, an upper and lower panel screen switching signal SW, a panel control signal LC and a shift clock signal SCK. These signals are generated in response to the timing signal DTMG from the CRT controller 12 and the clock signal CLK from the clock selection circuit 11. The panel timing controller 13 supplies these signals to the outside synchronizing circuit 14, a frame buffer interface 16, the flat panel display 3 and the panel data conversion circuit 15.

The panel data conversion circuit 15 converts the display data CDA for the CRT display supplied from the CRT controller 12 to panel display data PDA1 by subjecting the display data CDA to processing which includes imparting of graduation.

The frame buffer interface 16 supplies a read/write signal R/W to a ½ frame buffer 17 which designates a read timing or write timing for the ½ frame buffer 17 in response to the upper and lower panel screen switching signal SW. The panel display data PDA1 provided by the panel data conversion circuit 15 is written into the ½ frame buffer 17 in response to this read/write signal R/W. The data is also read from the ½ frame buffer 17 as display data PDA2 in response to the read/write signal R/W.

A data control circuit 18 selects either the display data PDA1 supplied from the panel data conversion circuit 15 or the display data PDA2 read from the ½ frame buffer 17. The selection is performed on a alternating basis line by line. The data control circuit 18 then supplies the selected data as display data PDA to the flat panel display 3.

Figure 2:
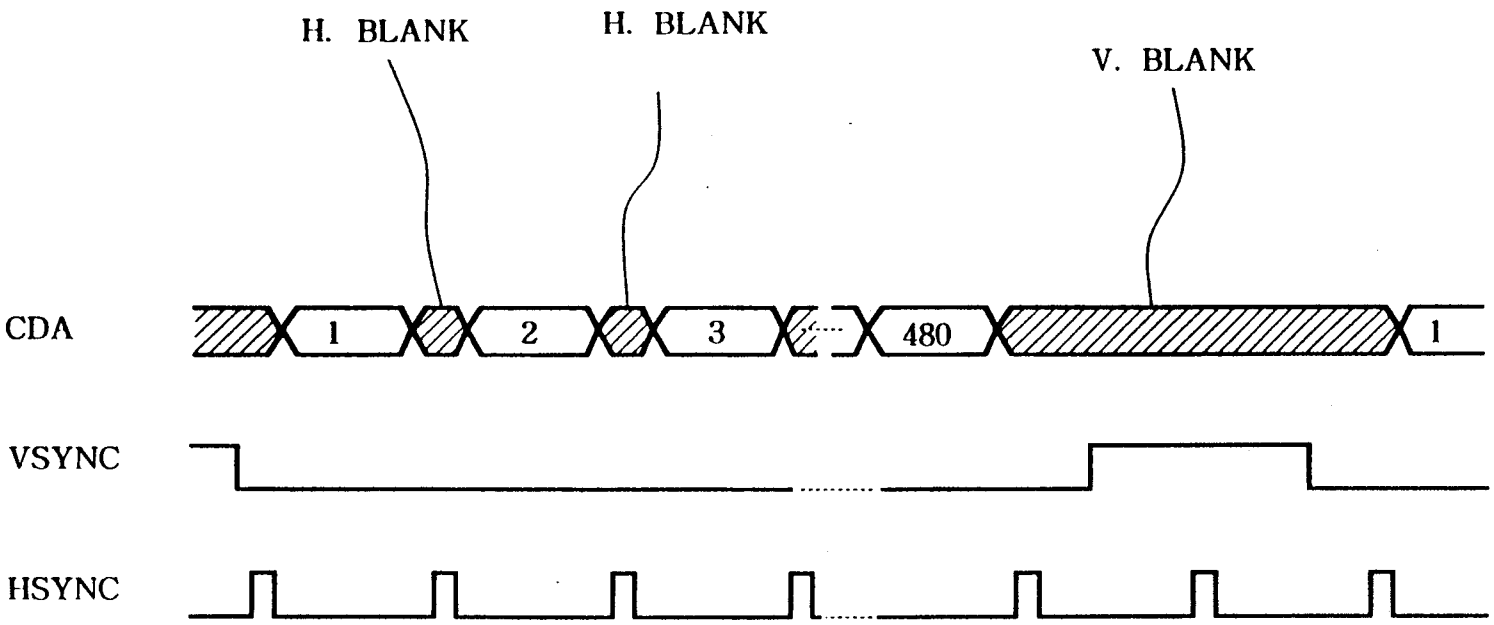
FIG. 2 is a timing chart showing CRT display timing for the display controller of FIG. 1.
Figure 3:
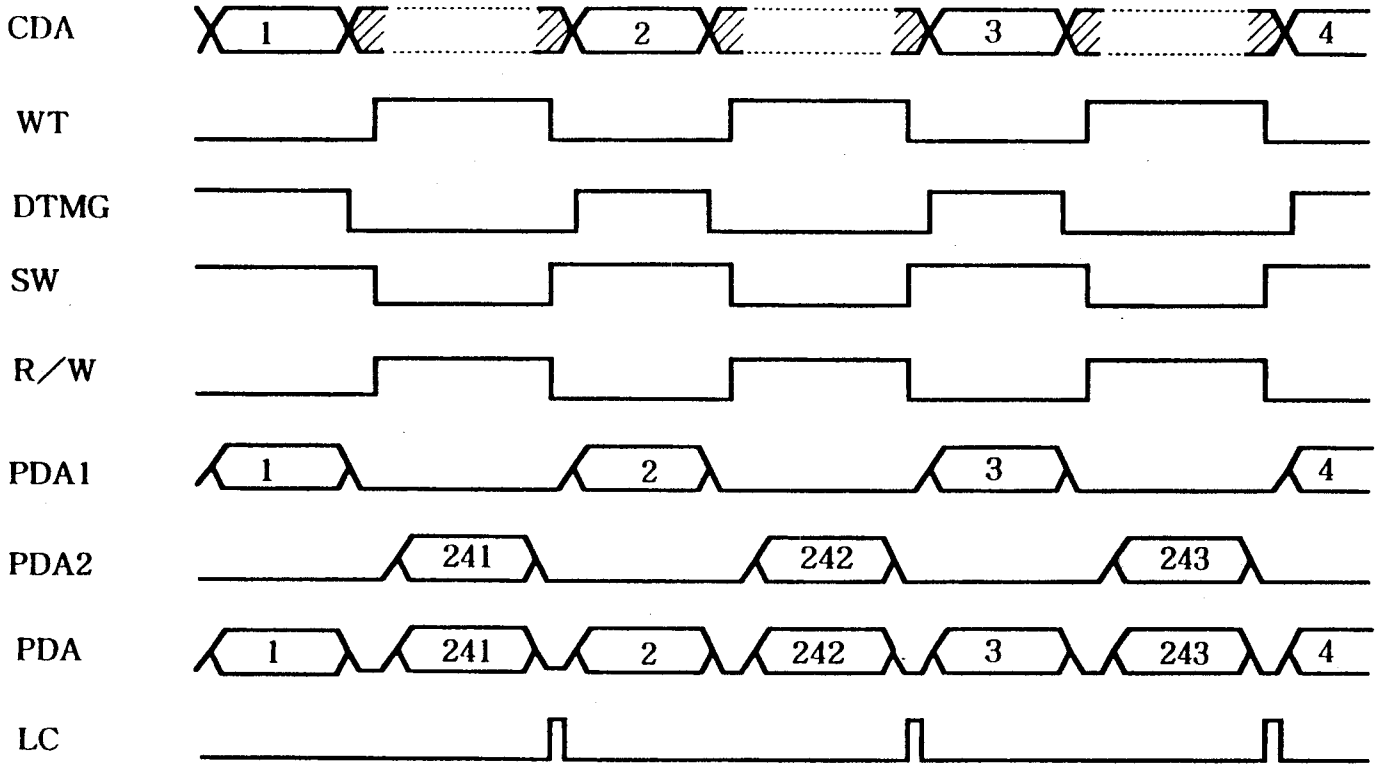
FIG. 3 is a time chart showing panel display timing for the display controller of FIG. 1.

The operation of the above-described display controller will now be described.

Where the display control of the CRT display (not shown) is to be performed, the clock signal CCK for the CRT display is selected by the clock selection circuit 11. The CRT controller 12 then produces, as shown in FIG. 2, a horizontal synchronizing signal HSYNC and vertical synchronizing signal VSYNC designating the CRT display timing in accordance with timing data. The timing data includes data representing the duration of the horizontal synchronizing period and timings for the start and end of the horizontal synchronizing period, as well as data representing timings for the start and end of a blanking period which are set in the timing controlling register (not shown) incorporated in the CRT controller 12. The display data VDA read from the VRAM 2 is provided as display data CDA from the CRT controller 12 in accordance with the above-described timing signals. The numerals in the display data CDA in FIG. 2 represent line numbers and, in this embodiment, one frame is composed of 180 lines.

Where the display control for the flat panel display 3 is performed, the panel clock signal PCK is selected by the clock selection circuit 11 so that not only the panel timing controller 13 but also the CRT controller 12 are operated in response to the panel clock signal PCK. The display timing for the flat panel display 3 is shown in FIG. 3. In this figure, numerals affixed to timing diagrams of the panel data PDA1, PDA2 and PDA represent line numbers of the flat panel display 3. In the flat panel display 3, the upper screen is composed of lines 1-240 and the lower screen is composed of lines 241-480.

As shown in FIG. 3, when the display timing signal DTMG has become active, display data CDA of the first line of the lines constituting the upper screen is provided by the CRT controller 12. This display data CDA is converted into the panel display data PDA1 by the panel data conversion circuit 15. Since the upper and lower panel screens switching signal SW is "1" at this time, the data control circuit 18 selects the display data PDA1 and provides it to the flat panel display 3.

Upon supplying the display data for the first line to the flat panel display 3, the display timing signal DTMG becomes inactive and, in response, the panel timing controller 13 supplies the wait signal WT to the CRT controller 12. The CRT controller 12 has its operation stopped and maintains the state it had before generation of the wait signal WT.

During this wait operation, the panel timing controller 13 switches the read/write signal R/W to the ½ frame buffer 17. This causes data for the 241st line of the lower screen which is stored in the ½ frame buffer 17 to be read from the ½ frame buffer 17. Since the upper and lower panel screen switching signal SW is "0" at this time, the data control circuit 18 selects the display data PDA2 which has been read from the ½ frame buffer 17 and then supplies it to the flat panel display 3.

Upon supplying of the display data for the 24lst line to the flat panel display 3, the wait signal WT from the panel timing controller 13 is stopped. In response, the CRT controller 12 causes the display timing signal DTMG to become active and resumes operation, which starts the compulsory display operation for the second line.

By repeating the above-described operation, the display data PDA is supplied to the flat panel display 3 alternately from the CRT controller 12 and the ½ frame buffer 17.

Accordingly, by setting the pulse interval of the wait signal WT at a proper value, the CRT controller 12 can be synchronized with the panel timing.

Figure 4A:
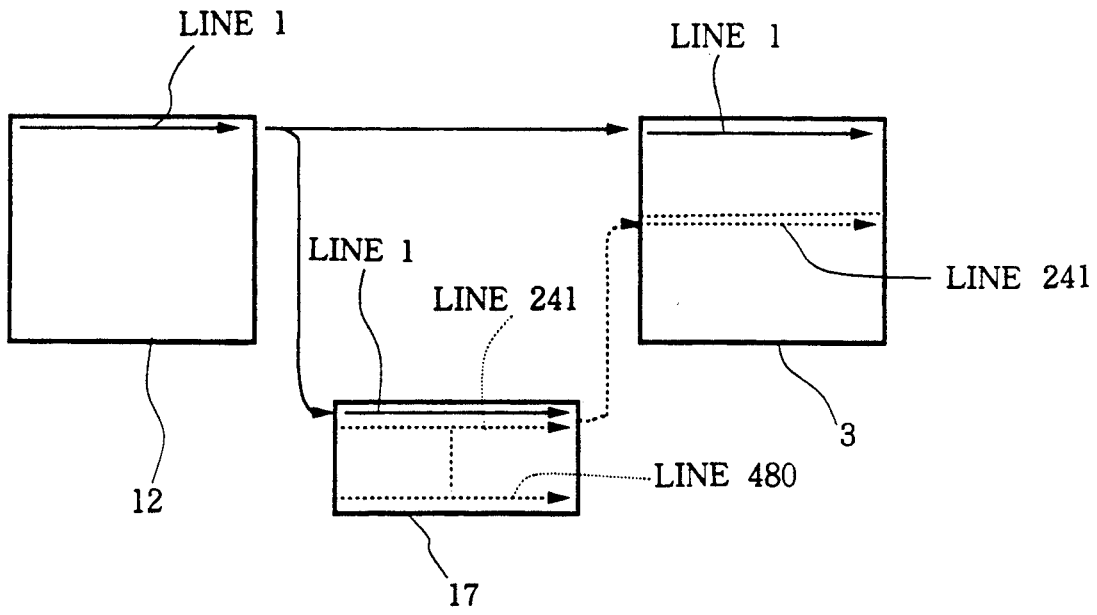
FIGS. 4A and 4B are schematic diagrams showing the flow of display data to be supplied to the panel display.
Figure 4B:
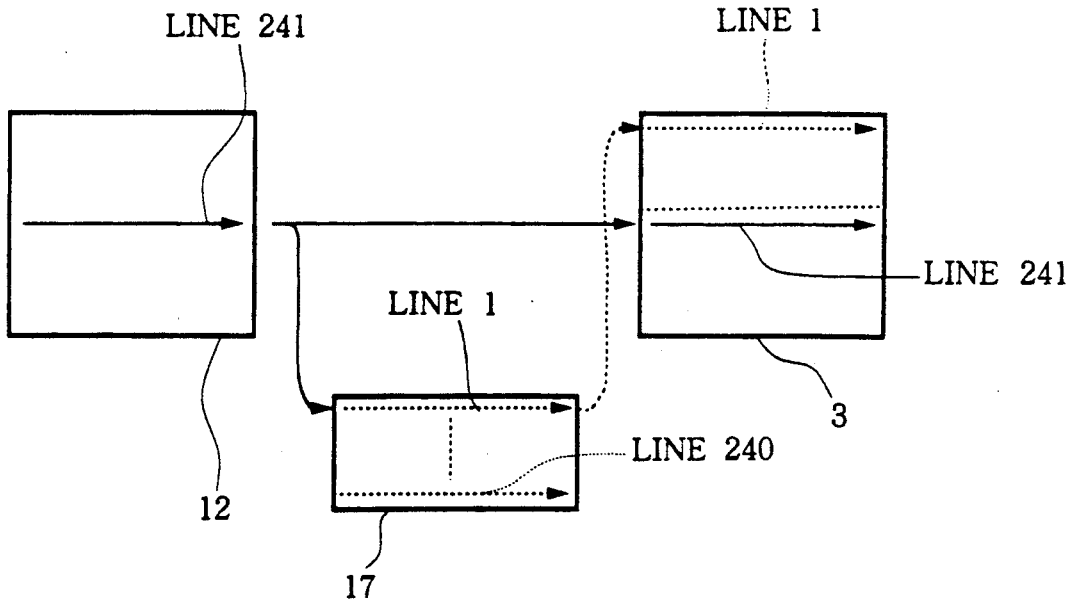
Figure 5:
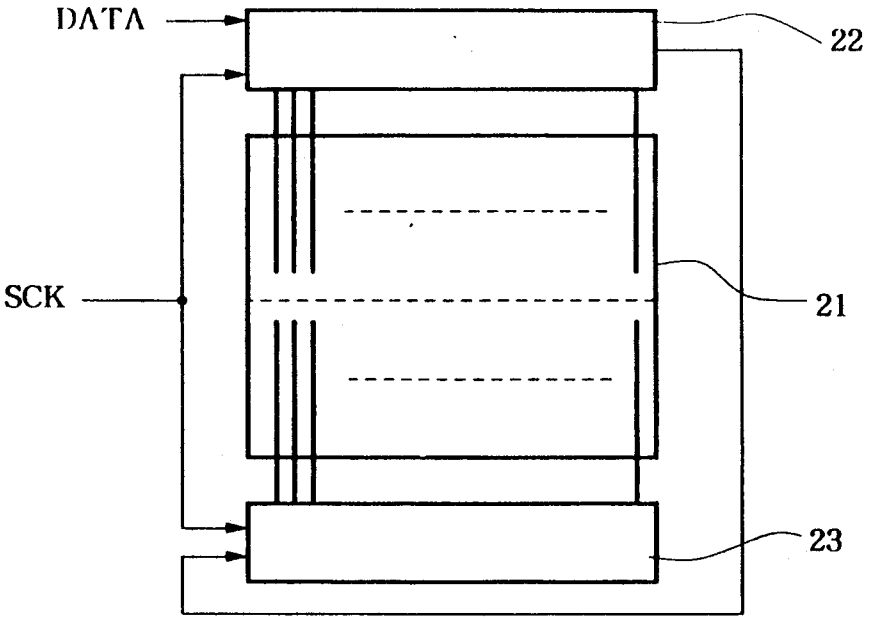
FIG. 5 is a diagram showing a double screen single drive type panel display.
Figure 6:
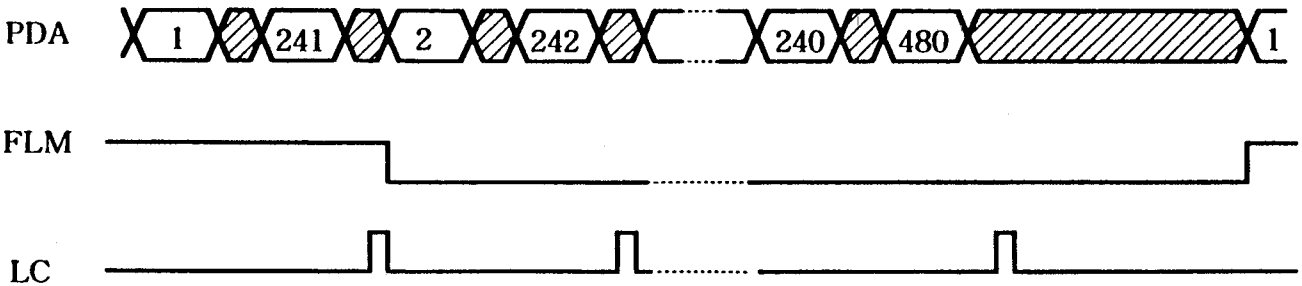
FIG. 6 is a timing chart showing display timing for the panel display of FIG. 5.

FIGS. 4A and 4B schematically show the flow of the display data PDA supplied from the CRT controller 12 and the ½ frame buffer 17 to the flat panel display 3.

When the CRT controller 12 is scanning the upper screen of the flat panel display 3, as shown in FIG. 4A, the CRT controller 12 supplies data to the first line of the flat panel display 3 in accordance with the scanning state and, simultaneously, causes the data for the first line to be stored in the ½ frame buffer 17. Upon completion of scanning all data for the first line, the CRT controller 12 supplies to the lower screen of the flat panel display 3, data for the 241st line which has already been stored in the ½ frame buffer 17. Upon completion of scanning all data for the 240th line by the CRT controller 12, a display operation for one frame is completed. At this time, data of the first through 240th lines have been stored in the ½ frame buffer 17. When data for the first line, for example, is to be written in a memory area in which data of the 241st line is stored, the data of 241st line may be preserved in a line buffer before starting the writing operation. By this arrangement, undesirable cancellation of display data PDA2 still to be read out by over-writing of the display data PDA1 can be prevented.

When the CRT controller 12 is scanning the lower screen of the flat panel display 3, as shown in FIG. 4B, data for the first line which has already been stored in the ½ frame buffer 1, is supplied to the flat panel display 3 and a display operation for the first line is performed. Then, data for the 241st line is supplied from the CRT controller 12 after release from the wait operation to the flat panel display 3. Simultaneously, data for the 241st line is also stored in the ½ frame buffer 17. Next, data for the second line is read from the ½ frame buffer 1, and supplied to the flat panel display 3. Upon storing of data for the 480th line in the ½ frame buffer 17 by repetition of the above-described operation, data for the 241st through 480th lines will have been stored.

In the display controller 1 of the above-described embodiment, a wait signal is applied compulsorily to the CRT controller 12 from outside to synchronize it with the panel timing, so that there is sufficient interchangeability achieved with the conventional application program used for the CRT display.

Further, since display data is successively stored in the ½ frame buffer 17 while the display data PDA1 supplied from the CRT controller 12 and the display data PDA2 supplied from the ½ frame buffer 17 is alternately selected, a display control of a double screen single drive type flat panel display can be performed without failure.

Figure 7:
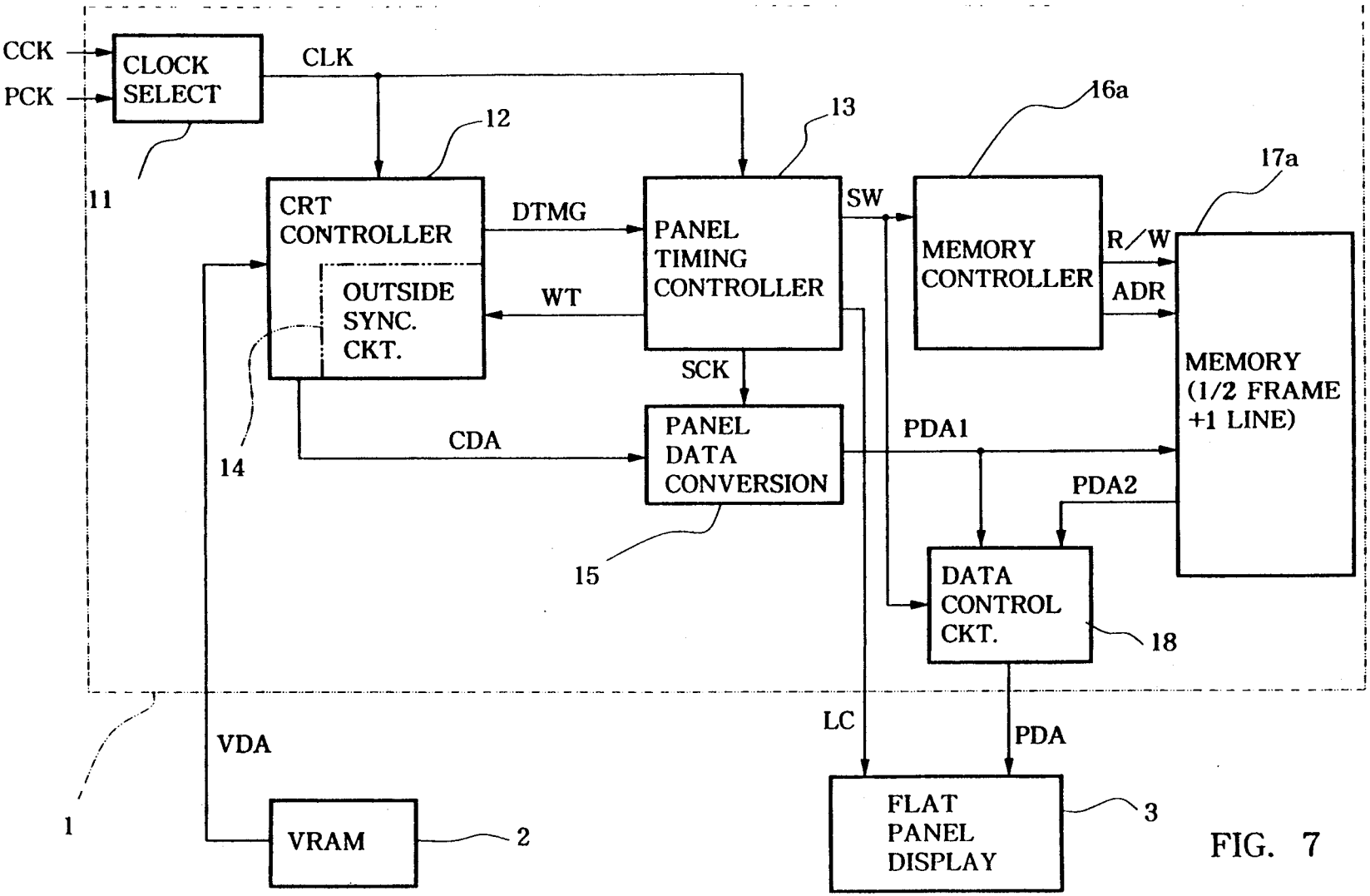
FIG. 7 is a block diagram showing another embodiment of the present invention.
Figure 8:
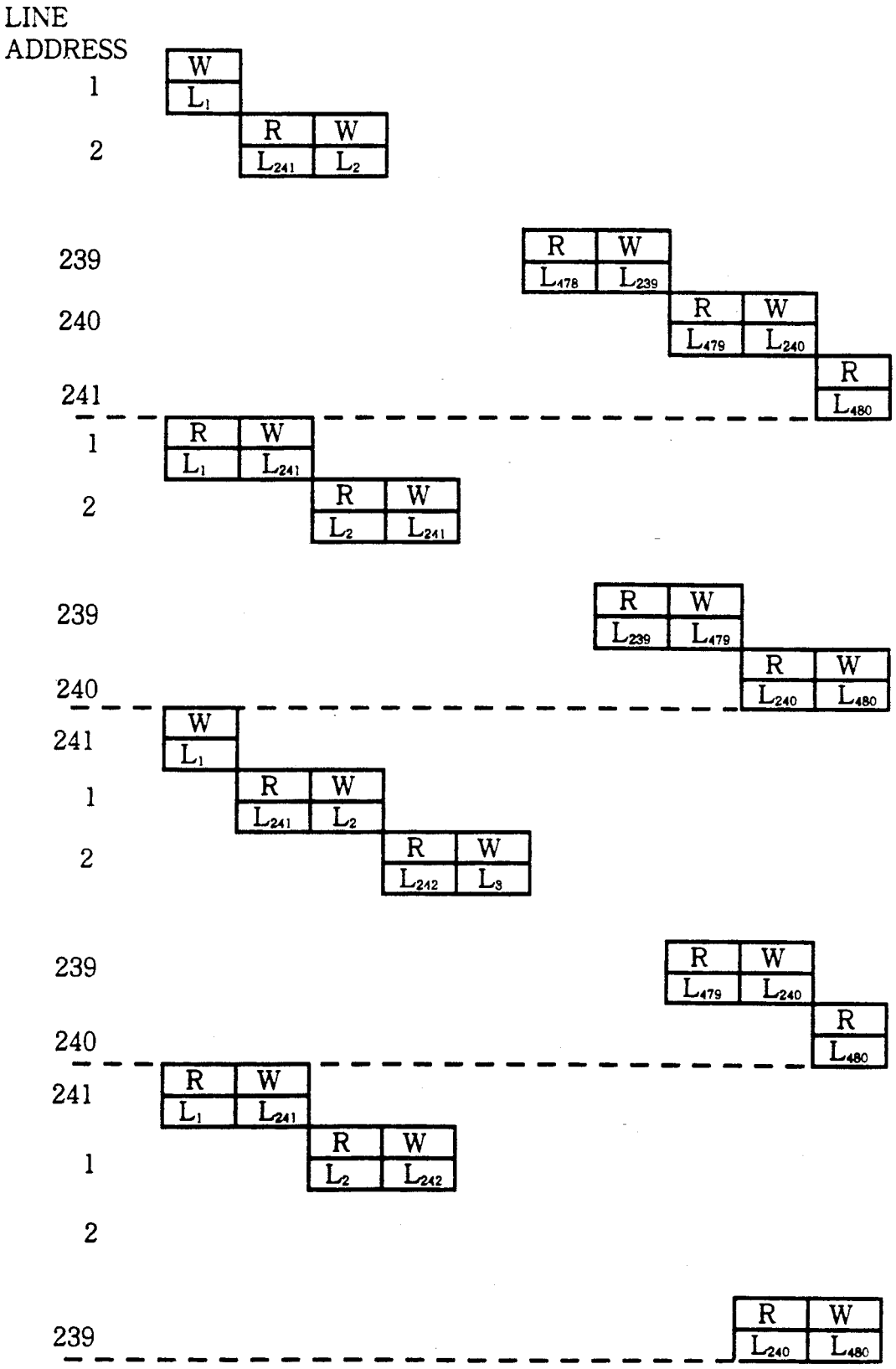
FIG. 8 is a schematic diagram showing reading from and writing to the memory by the memory controller in FIG. 8.
Figure 9:
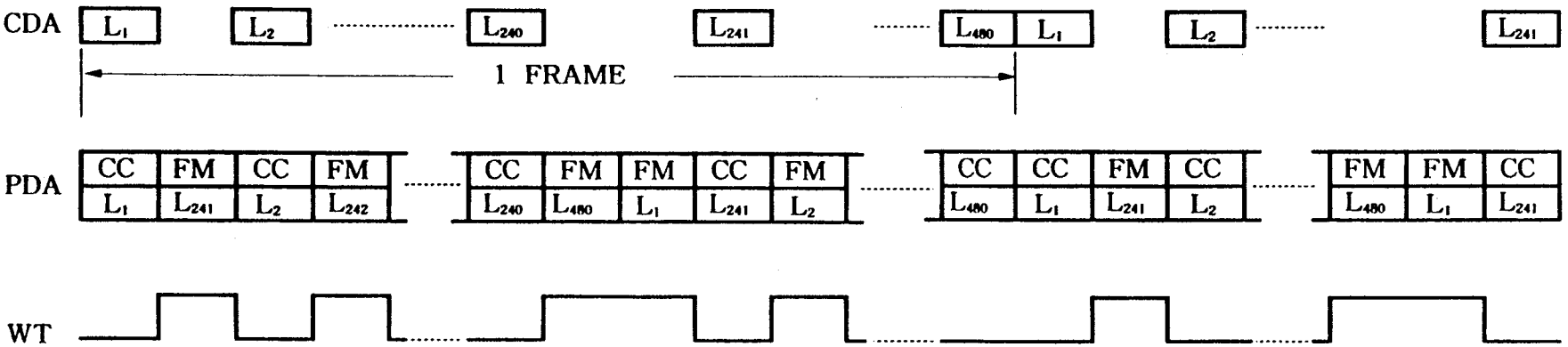
FIG. 9 is a timing chart showing the operation of the memory controller in FIG. 8.

Another embodiment of the present invention will now be described with reference to FIGS. 7 to 9. In FIG. 7, the same component parts as shown in FIG. 1 are designated by the same reference characters and a detailed description of those components will, therefore, be omitted.

Referring to FIG. 7, in response to the upper and lower screen panel switching signal SW, a memory controller **16*a* supplies a read/write signal R/W designating read timing and write timing of a memory 17*a* and an address signal ADR designating a read/write address of the memory 17*a* which is used as a ½ frame buffer. The memory 17*a* has a capacity of at least a ½ frame and one line e.g., 241 lines if one frame consists of 480 lines. In this example, the memory 17*a* has a capacity of ½ frame and one line i.e., 241 lines. The panel display data PDA1 supplied from the panel data conversion circuit 15 is written in the memory 17*a* in response to the read/write signal R/W and read out from the memory 17*a*** as the display data PDA2 in response to the read/write signal R/W.

The operations for writing data in and reading it from the memory **17*a* will be described with reference to FIGS. 8 and 9. Reading and writing of data is controlled by the memory controller 16*a***.

In this embodiment, the memory **17*a* used as the ½ frame buffer has a data capacity of 241 lines. FIG. 8 shows the relation between line addresses 1-241 of the memory 17*a* and line numbers L1-L480 of data which are written into or read out from these line addresses. FIG. 9 shows timing relations among the data CDA provided by the CRT controller 12, display data PDA supplied from the data control circuit 18 to the flat panel display 3 and the wait signal WT. In FIG. 8, the reference character W represents that the display data PDA1 provided by the panel data conversion circuit 15 is displayed through the data control circuit 18 and also written in the memory 17***a* through the panel data conversion circuit 15. The reference character R represents that the display data PDA2 is read from the memory 17*a* and displayed through the data control circuit 18. In FIG. 9, the reference character CC represents a time period during which the display data PDA1 is used (i.e., the data CDA provided by the CRT controller 12 is displayed directly as the display data PDA1); and during the same period, the same data is written in the memory 17*a*. The reference character FM represents a time period during which the display data PDA2 is used (i.e., the display data PDA2 read from the memory 17*a* is displayed), which occurs when the wait signal WT is on.

When the CRT controller 12 is scanning the upper screen, data for line number L1 as the display data PDA1 based on the CDA data provided by the CRT controller 12 is . displayed as the display data PDA. The line data is also stored in the memory area of line address 1 of the memory 17*a*. Then, data for line number L241 which has already been stored in the memory area of line address 2 of the memory 17*a* is read out and displayed as the display data PDA. Thereafter, data for line number L2 as the display data PDA1 is displayed as the display data PDA and also stored in the memory area of line address 2 in the memory 17*a*. The process continues throughout the upper screen until eventually data for line number L479 which has already been stored in the memory area of line address 240 of the memory 17*a* is read out and displayed as the display data PDA. Thereafter, data for line number L240 as the display data PDA1 is displayed as the display data PDA and also stored in the memory area of the same line address 240 of the memory 17*a*. Then, data of line number L480 which has already been stored in the memory area of line address 241 of the memory 17*a* is read out and displayed as the display data PDA. Thus, scanning of the upper screen by the CRT controller 12 is completed.

Next, the CRT controller scans the lower screen. Data for line number L1 which has already been stored in the memory area of line address 1 of the memory 17*a* is read out and displayed as the display data PDA. Thereafter, data for line number L211 as the display data PDA1 is displayed as the display data PDA and is also stored in the same memory area of line address 1 of the memory 17*a*. Then, data for line number L2 which has already been stored in the memory area of line address 2 is read out and displayed as the display data PDA. Thereafter, data for line number L242 as the display data PDA1 is displayed as the display data PDA and is also stored in the memory area of the same line address 2. The process continues throughout the lower screen until eventually data for line number L240 which has already been stored in the memory area of line address 240 is read out and displayed as the display data PDA. [and thereafter] Thereafter, data for line number L480 as the display data PDA1 is displayed as the display data PDA and also stored in the memory area of the same line address 240. Thus, scanning of the lower screen of the CRT controller 12 is completed. By the above-described scanning operation of the upper and lower screens, scanning of one frame by the CRT controller 12 is performed.

In the next scanning of the upper screen (i.e., scanning of the next frame by the CRT controller 12), the starting writing address of the memory 17*a* is shifted by one line from the writing address for scanning of the preceding frame in the reverse direction to the direction of writing (i.e., writing is started from line address 241). Thus, data for line number L1 as the display data PDA1 is displayed as the display data PDA and is also stored in the memory area of line address 241 of the memory 17*a*. Then, data for line number L241 which has already been stored in the memory area of line address 1 of the memory 17*a* is read out and displayed as the display data PDA. Thereafter, data for line number L2 as the display data PDA1 is displayed as the display data PDA and is stored in the memory area of the same line address 1. The process continues until eventually data for line number L479 which has already been stored in the memory area of line address 239 is read out and displayed as the display data PDA and is stored in the memory area of the same line address 239. Then, data for line L480 which has already been stored in the memory area of line address 240 is read out and displayed as the display data PDA.

As described above, according to this embodiment, a memory having a capacity of at least ½ frame and one line is used and the writing address in the memory 17*a* is shifted by one line each time a new frame is scanned, so that the necessary data in the memory 17*a* remains uncancelled when data for one line is written at the beginning of a new frame.

In the above-described manner, reading data out from and writing data into the memory 17*a* is repeated. By this arrangement, the memory 17*a* may consist of a general-purpose memory having a capacity of 241 lines (a ½ frame and one line) which can be utilized efficiently as the ½ frame buffer.

As in the display controller in the previously-described embodiment, the display controller 1 of this embodiment can subject the CRT controller 12 to the compulsory wait operation from outside to synchronize with the panel timing. This allows for sufficient interchangeability with the conventional application program for the CRT display.

Further, by using the general-purpose memory 17*a* efficiently as the ½ frame buffer and storing display data successively in the memory 17*a* while alternately selecting the display data PDA1 provided by the panel data conversion circuit 15 and the display data PDA2 provided by the memory 17*a*, the display control of the double screen single drive type flat panel display 3 can be performed without failure.

What is claimed is:

1. A panel display control device for use with display data, the device comprising:

a clock for providing a basic clock;

a panel display having a first screen and a second screen display;

a CRT controller operated in response to the basic clock and a stored set of values for a CRT timing to provide a display timing signal for the panel display and display data in accordance with the set value of the CRT timing;

a panel data conversion circuit for converting the display data provided by the CRT controller to panel display data for the panel display;

a buffer for storing at least ½ frame of the panel display data provided by the panel data conversion circuit;

a panel timing controller operated in response to the basic clock and providing a wait signal for synchronizing the CRT controller with the panel display timing without changing the stored set of values for the CRT timing, the panel timing controller further providing a screen switching signal for switching the first and second screens synchronized with the wait signal, and a display control signal for the panel display;

a buffer control circuit for controlling a read timing and a write timing of the buffer in response to the screen switching signal, such that the panel display data provided by the panel data conversion circuit is written line by line into the buffer and is read out from the buffer line by line; and a data control circuit for alternately selecting line by line between the panel display data provided by the panel data conversion circuit and panel display data provided by the buffer, such that the selected display data is supplied to the panel display.

2. A panel display control device as defined in claim 1, wherein the buffer comprises a general-purpose memory for storing ½ frame and one line of the panel display data, and wherein the buffer control circuit shifts a writing start address of the buffer by one line a reverse direction to a scanning direction for writing at a beginning of each new frame.

* * * * *